US005695190A

United States Patent [19]

McClain

[11] Patent Number: 5,695,190

[45] Date of Patent: Dec. 9, 1997

[54] METHOD FOR PLAYING BOARD GAME

[76] Inventor: Albert A. McClain, 2071 General St., Rancho Palos Verdes, Calif. 90275

[21] Appl. No.: 725,470

[22] Filed: Oct. 4, 1996

[51] Int. Cl.[6] ..... A63F 3/00

[52] U.S. Cl. ..... 273/249

[58] Field of Search ..... 273/242, 243, 273/248, 249, 251, 252, 254

[56] References Cited

U.S. PATENT DOCUMENTS 5,261,671 11/1993 Wyatt ..... 273/249

5,435,566 7/1995 Scuderi ..... 273/249 X 5,478,086 12/1995 Aylett ..... 273/249 X 5,511,792 4/1996 Simmons et al. ..... 273/249 X 5,516,290 5/1996 Quigley et al. ..... 273/249 X

*Primary Examiner*—William E. Stoll

*Attorney, Agent, or Firm*—Irving Keschner

[57] ABSTRACT

Playing pieces are provided to each player for movement among the spaces in accordance with the roll of the die and indicia printed on selected spaces when a playing piece is moved to that location. The object of the game is for one player to cross a space designated state line, the crossing being determined by the number of points a player has accumulated during play and the number rolled on a die.

3 Claims, 2 Drawing Sheets

METHOD FOR PLAYING BOARD GAME

BACKGROUND OF THE INVENTION

1. Description of the Invention

The present invention relates to a board game which combines the excitement associated with a game with teachings related to earthquakes.

2. Description of the Prior Art

A number of board games have been available in the prior art, particularly those which move players' pieces to areas of the board in accordance with the call of a die and game instructions. For example, the game of Monopoly utilizes the movement of players' pieces along sequential squares formed adjacent the edges of the board. U.S. Pat. No. 4,323,249 to Brady discloses a board game which utilizes game pieces, dice and a "driving" track around the center of the board, the game board providing education for players in defensive driving skills in traffic situations.

What is desired is to provide a board game which, while providing the excitement of a board game, also teaches the players about earthquakes.

SUMMARY OF THE PRESENT INVENTION

The present invention provides a board game comprising a playing board having a plurality of spaces thereon, playing pieces, a die and sets of cards. Playing pieces are provided to each player for movement among the spaces in the accordance with the roll of the die and indicia formed on selected spaces when a playing piece is moved to that space. The object of the game is for one player to "cross" the state line, thus escaping from an area prone to earthquakes.

The present invention thus provides a simple, inexpensive board game which combines the intellectual skills required in board games with the public interest in preparing for earthquakes.

BRIEF DESCRIPTION OF THE DRAWINGS

For a better understanding of the invention as well as other objects and further features thereof, reference is made to the following description which is to be read in conjunction with the accompanying drawing wherein.

DESCRIPTION OF THE INVENTION

Figure 1:
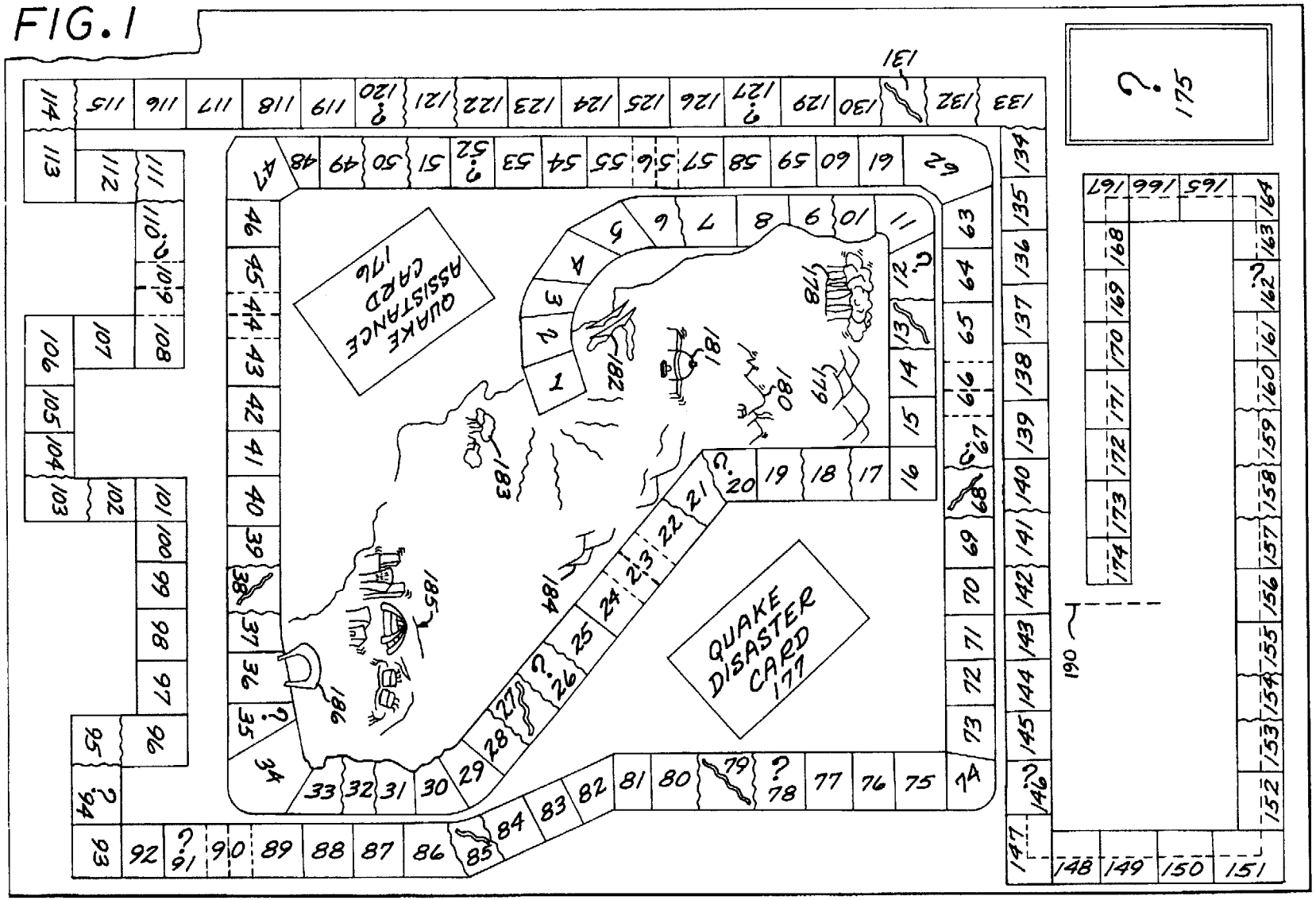
FIG. 1 is a plan view of the surface of the playing board of the present invention.

Referring to FIG. 1, a plan view of the preferred embodiment of the playing board 10 of the present invention is illustrated. The board comprises 174 spaces on which a playing piece can land, spaces 175, 176 and 177 whereat certain cards are positioned and various features 178–186 of a particular earthquake area from which the player is seeking to escape. In the example illustrated, the earthquake area is California, reference numeral 178 representing the Redwood National Park, numerals 179 and 184 representing mountains, 180 Mammoth Mountain, 181 Sacramento, 182 San Francisco, 183 the Big Sur, and 185 representing Los Angeles and 186 Mexico.

Figure 3:
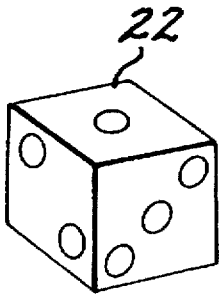
FIG. 3 is a perspective view of a die used in the present invention.
Figure 2:
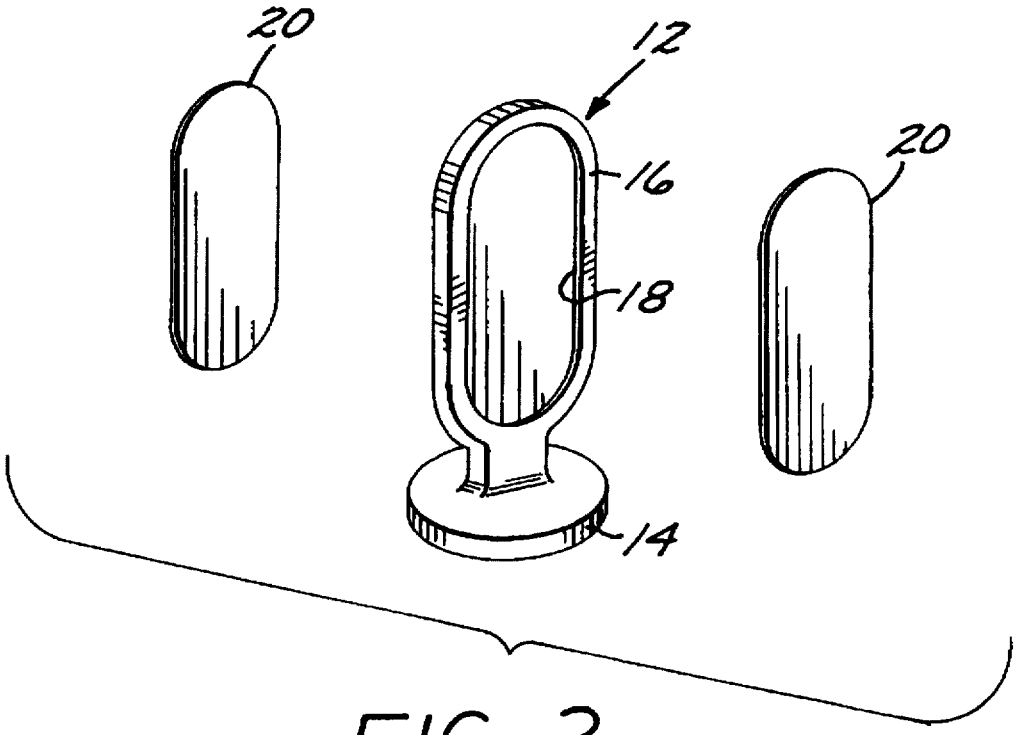
FIG. 2 is a perspective view illustrating the playing pieces utilized in the present invention.

An example of a playing piece, or token, 12 is shown in FIG. 2. The playing piece (each player is given on such piece) comprises a base portion 14 and a vertical extending portion 16 having two recesses 18 (only one shown) to receive decorative inserts 20. The movement of each playing piece 12 by a player is determined by the roll of die 22 shown in FIG. 3.

The cards used on the board 10 are comprised of the following:

1. Quake Assistance Cards ("QAC")—a player landing on a space labeled QAC receives 100 points and helps the player along the board route to the state line (these cards are positioned in space 176).
2. Quake Disaster Cards ("QDC")—a player landing on a space labeled QDC is delayed from reaching the state line (these cards are placed in space 177).
3. Earthquake Question Cards ("EQC")—each EQC contains questions regarding earthquake preparedness and corresponding answers. If the question is answered correctly, the player collects a certain number of points and is allowed to move his playing piece a certain number of spaces in the forward direction (these cards are placed in space 175).

To play, each player rolls the die in turn and moves that many spaces from the start space 1. Upon landing on a space as determined by the roll of the die, the player does what the indicia on the space says. For example, if the indicia says to move ahead five spaces or back five spaces, the playing piece is moved accordingly; no further action is taken until the next roll of the die (player does not do what the indicia on the space says to do when a player is penalized and moves backwards, the roll being over until the player's next turn) i.e, each player's turn involves the roll of the die, moving the number of spaces dictated by the die roll and the movement/action noted by the indicia on that space.

In order for a player to be declared the winner, the player must accumulate 1000 points and to roll 1 on the die to cross the state line indicated by reference numeral 190. All players must stop at state line 190 regardless what is rolled on the die. The player collects points along the game path by landing on the appropriate spaces or by answering the questions on the EQC cards correctly. If the player does not have at least 1000 points, the die can be rolled to get across state line 190. In particular, the player has to accumulate three (3) number 3's on the die during his/her turn at rolling the die (note that each player takes one turn, in sequence, in rolling the die). If, for example, a player is on space 173 and rolls a 4, he/she goes to the state line 190 only. Play then continues as set forth hereinabove. In other words, a player can not pass state line 190 regardless of the number rolled. In summary, a player crosses the state line 190 if he/she accumulates 1,000 points and shoots a roll of one (1) on the die. A player that does not have the necessary 1,000 points can also cross the state line by rolling a three (3) on the die three times; if not rolled in succession, the number of rolled threes can be saved until the required total has been accumulated.

The non-card spaces on the board 10 fall into one of the following categories:

1. Freeway Space is worth 50 points—if a player lands on this space, he/she has the option of rolling a 6 on the die. If successful, the player goes to the start of the freeway (space 147) and collect 500 points. If the die is not rolled, the player keeps the 50 points and continues to play the game. If any number other than 6 is rolled, the player goes back 20 spaces and loses his/her next turn.

Red Cross Space is worth 200 points—a player will receive a token, or chip, that can be used for any encounter, such as leaving any negative space landed on, or it can be held until the player reaches the start of the freeway and use it to double the player's points.

Fault Zone—if a player lands on this space, the player rolls the die again. If a 1, 2 or 3 is rolled, the penalty is two lost turns; if a 4, 5 or 6 is rolled, the player moves backwards 15 spaces.

Safety—75 points

Fire Department—100 points

Police Department—100 points

City Maintenance—100 points

Good Samaritan—100 points

National Guard—100 points

A player is chosen to be the distributor of points and tokens. The person to the left of the die roller is responsible for asking the quake preparedness questions.

The spaces on board 10 are as follows:

1—Start
2,3—Blank
4—QAC
5—Safety Zone
6—Blank
7—Back 3 spaces
8—QAC
9—Blank
10—QDC
11—Forward 4 spaces
12—EQC
13—Fault Zone
14,15—Blank
16—Start Over
17—Blank
18—Lose 1 turn
19—Red Cross
20—EQC
21—QDC
22—Blank
23—Freeway
24—QAC
25—Back 7 spaces
26—EQC
27—Fault Zone
28—Move back 4 spaces
29—Blank
30—Red Cross
31—Blank
32—QDC
33—Blank
34—Back 8 spaces
35—EQC
36—QAC
37—Blank
38—Fault Zone
39—Blank
40—Fire Department
41—Blank
42—Red Cross
43—Blank
44—Freeway
45—Lose 2 turns
46—QAC
47—Safety Zone
48,49—Blank
50—Fault Zone
51—Blank
52—EQC
53—Lose 1 turn
54—Blank
55—Red Cross
56—Freeway
57—Blank
58—QAC
59—Safety Zone
60—Back 13 spaces
61—Blank
62—Back 10 spaces
63—Police Department
64—Red Cross
65—Blank
66—Freeway
67—EQC
68—Fault Zone
69—QAC
70—Blank
71—Lose 1 turn
72,73—Blank
74—Safety Zone
75—Red Cross
76—Back 12 spaces
77—QAC
78—EQC
79—Fault Zone
80—Lose 1 turn
81—Blank
82—QAC
83—Blank
84—Back 6 spaces
85—Fault Zone
86,87—Blank
88—National Guard
89—Blank
90—Freeway
91—EQC
92—Blank
93—Safety Zone
94—EQC
95—QDC
96—Red Cross
97—Blank
98—QAC
99—Lose 2 turns
100–102—Blank
103—QDC
104—City Maintenance
105—Blank
106—Back 8 spaces
107—QAC
108—Blank
109—Freeway
110—EQC
111—Fault Zone
112—Blank
113—Safety Zone
114—QDC
115–117—Blank
118—QAC
119—Blank
120—EQC
121—QDC
122–123—Blank
124—Back 11 spaces
125—Blank
126—Red Cross 127—EQC
129—Blank
130—Good Samaritan
131—Fault Zone
132—QDC
133—Back 6 spaces
134–136—Blank
137—Back 8 spaces
138—Blank
139—Lose 2 turns
140—Blank
141—QDC
142—QAC
143,144—Blank
145—Lose 1 turn
146—EQC
147—Freeway Start
148—Blank
149—Back 9 spaces
150–157—Blank
158—Lose 2 turns
159—Back 10 spaces
160,161—Blank
162—EQC
163–165—Blank
166—Lose 1 turn
167–171—Blank
172—Back 8 spaces
173,174—Blank Although the spaces set forth hereinabove have specific instructions associated therewith, it should be clear that the instructions can be rearranged so that they appear in different sequences and locations.

While the invention has been described with a reference to its preferred embodiment, it will be understood by those skilled in the art that various changes may be made and equivalents may be substituted for elements thereof without departing from the true spirit and scope of the invention. In addition, modifications may be made to adapt a particular situation or material to the teachings of the invention without departing from its essential teachings.

What is claimed is:

1. A method of playing a board game directed to leaving an area designated as earthquake prone, the board game having a playing board and a playing area comprising the steps of:

dividing said playing area into a plurality of spaces;

placing a plurality of playing pieces initially in predetermined ones of said spaces for a first and second player, rolling a die to determine the number of total spaces the pieces are to be moved initially in each turn of play, the player first landing at a predetermined space having accumulated a predetermined number of points and rolling the die until a particular number is rolled being the winner of the game; and moving the pieces of said first and second player in a predetermined sequence, certain of said spaces having indicia thereon defining the movement of a playing piece landing thereon, the piece then being moved in accordance with the instruction, a player being penalized and instructed to move backwards causing the roll to be over until the player's next turn.

2. The method of claim 1 wherein certain of said spaces have indicia thereon directing the player whose play piece lands thereon to select a card from one stack of three card stacks, the first card stack directing a player to move forward a predetermined number of spaces, the second card stack representing a delay or barrier to a player during an earthquake directing the player to move backwards a predetermined number of spaces and the third card stack requesting the player to answer a question about earthquakes, a correct answer enabling the player to move forward a predetermined number of spaces and obtaining a certain number of points.

3. The method of claim 1 wherein a player is also declared the winner of the game if the player has accumulated a predetermined number of points less than the number required to pass the line by rolling a predetermined number on the die a predetermined number of times in succession, if not rolled in succession, the number being accumulated until the predetermined total of the numbers is obtained.

* * * * *